US006817359B2

(12) United States Patent
Deas et al.

(10) Patent No.: US 6,817,359 B2
(45) Date of Patent: Nov. 16, 2004

(54) SELF-CONTAINED UNDERWATER RE-BREATHING APPARATUS

(76) Inventors: Alexander Roger Deas, King's Gate Lodge, Dalkeith, Edinburgh (GB), EH22 1ST; Marat Vadimovich Evtukhov, 23/3-87 Pr.Marshala Kozakova, St. Petersburg (RU), 198332; Alexey Nikolaevich Bogatchev, 18/3-205 ul.Aviakonstructorov, St. Petersburg (RU), 197373

( * ) Notice: Subject to any disclaimer, the term of this patent is extended or adjusted under 35 U.S.C. 154(b) by 0 days.

(21) Appl. No.: 10/425,654

(22) Filed: Apr. 30, 2003

(65) Prior Publication Data

US 2003/0188745 A1 Oct. 9, 2003

Related U.S. Application Data

(63) Continuation-in-part of application No. PCT/RU01/00483, filed on Oct. 31, 2001.

(60) Provisional application No. 60/244,199, filed on Apr. 10, 2002.

(51) Int. Cl.[7] ..... B63C 11/02

(52) U.S. Cl. ..... 128/201.27; 128/201.28; 128/202.22; 128/205.12; 128/205.28

(58) Field of Search ..... 128/201.27, 201.28, 128/202.22, 205.12, 205.28

(56) References Cited

U.S. PATENT DOCUMENTS

| | | | | | |
|---|---|---|---|---|---|
| 3,556,098 | A | * | 1/1971 | Kanwisher et al. | 128/202.22 |
| 3,802,427 | A | * | 4/1974 | Banjavich et al. | 128/201.25 |
| 3,820,537 | A | * | 6/1974 | Almqvist et al. | 128/201.27 |
| 3,828,611 | A | * | 8/1974 | Shamlian et al. | 73/300 |
| 3,968,795 | A | * | 7/1976 | O'Neill et al. | 128/201.27 |
| 4,273,120 | A | * | 6/1981 | Oswell | 128/204.26 |
| 4,800,373 | A | * | 1/1989 | Mayz | 340/626 |
| 4,949,072 | A | * | 8/1990 | Comerford et al. | 340/525 |
| 4,964,404 | A | | 10/1990 | Stone | 128/204.22 |
| 4,974,585 | A | | 12/1990 | Stone | 128/205.12 |
| 5,040,528 | A | * | 8/1991 | O'Neill | 128/201.27 |

(List continued on next page.)

FOREIGN PATENT DOCUMENTS

| | | |
|---|---|---|
| DE | 196 28 356 A | 1/1998 |
| EP | 0 805 105 A | 11/1997 |
| FR | 2 454 655 | 11/1980 |
| JP | 01 036597 A | 2/1989 |
| JP | 02 179594 A | 7/1990 |

OTHER PUBLICATIONS

Severinghaus J W et al: <<Correction Factors for Infrared Carbon Dioxide Pressure Broadening by Nitrpgen, Nitrous Oxide and Cyclopropane>> Anesthesiology, American Society of Anesthesiologists No. 22, 1961, pp. 429–432, XP008003607 Philadelphia, PA, US ISSN: 0003–3022.

*Primary Examiner*—Aaron J. Lewis

(57) ABSTRACT

Self-contained underwater re-breathing apparatus having a breathing circuit, an injection system for adding fresh breathable gas to the breathing circuit, and an automatic control system including a microcomputer for monitoring physical parameters in the breathing circuit and controlling the feeding of breathable gas to the breathing circuit in accordance with said physical parameters. The re-breathing apparatus has a bailout system automatically activated in an emergency, where the breathing circuit is shut off, and the diver starts inhaling directly from the breathable gas supply and exaling to the environment.

With the system of the invention, a part of the existing closed circuit is used for bailout, and no separate bailout circuit is provided. Therefore, there is no need to incorporate in the mouthpiece means for switching from one breathing circuit to another, and the mouthpiece can be kept smaller and simpler. Further, switching to bailout is fully automated, so that no actions are required from the diver.

10 Claims, 5 Drawing Sheets

U.S. PATENT DOCUMENTS 5,042,470 A * 8/1991 Kanesaka ..... 128/202.22
5,127,398 A 7/1992 Stone ..... 128/204.18
5,195,516 A * 3/1993 Grimsey ..... 128/204.26
5,368,018 A 11/1994 Stone ..... 128/201.28
5,457,284 A * 10/1995 Ferguson ..... 128/201.27
5,503,145 A 4/1996 Clough ..... 128/204.22
5,570,688 A * 11/1996 Cochran et al. ..... 128/205.23
5,617,848 A * 4/1997 Cochran ..... 128/205.23
5,845,235 A * 12/1998 Luukkanen et al. ..... 702/127
5,860,418 A * 1/1999 Lundberg ..... 128/202.22
5,913,307 A * 6/1999 Taieb et al. ..... 128/205.23
5,926,779 A * 7/1999 Garofalo ..... 702/138
6,003,513 A 12/1999 Readey et al. ..... 128/205.24
6,360,182 B1 * 3/2002 Hales ..... 702/139

* cited by examiner

SELF-CONTAINED UNDERWATER RE-BREATHING APPARATUS

This is a cip of application of PCT/RU01/00483 filed Oct. 31, 2001 which claims benefit of Provisional Appl. 60/244,199, filed Apr. 10, 2002.

FIELD OF THE INVENTION

The present invention relates generally to diving systems and more particularly to self-contained underwater re-breathing apparatus.

BACKGROUND OF THE INVENTION

Self-contained underwater re-breathing apparatus or rebreathers are well known in the art. As the name implies, a rebreather allows a diver to "re-breathe" exhaled gas. Rebreathers consist of a breathing circuit from which the diver inhales and into which the diver exhales. The breathing circuit generally includes a mouthpiece in communication with an inlet to and outlet from, a scrubber canister for scrubbing $CO_2$ from the exaled gas. At least one variable-volume container known as "counterlung" is incorporated in the breathing circuit. Exaled gas fills the counterlung. Diver's inhalation draws the exaled gas from the counterlung through the scrubber canister. $CO_2$-depleted gas from the scrubber canister is fed again to the mouthpiece and the diver's lungs.

A typical rebreather further includes an injection system for adding fresh breathable gas from at least one gas cylinder to the breathing circuit. It is vital to provide proper physical parameters (such as partial pressure of oxygen or $PPO_2$) of the breathing gas mixture inside the breathing circuit in accordance with pressure (determined by the depth of diving). This can be achieved by controlling said injection, which can be operated manually or automatically. In simple cases, that is small and constant depths, manual control can be employed, usually limited to adjusting a regulator for feeding breathable gas to a predetermined $PPO_2$. More or less complex diving profile at substantial depths requires automatic control.

Thus, up-to-date rebreathers usually have an automatic control system including a microcomputer for monitoring physical parameters in the breathing circuit and controlling the feeding of breathable gas to the breathing circuit in accordance with said physical parameters.

It can be seen that a rebreather is a complex system incorporating a good deal of automation. Meanwhile, it is well known that failure is more probable for a complex system. Thus, a need exists for a reliable bailout system capable, in an emergency, of supporting the diver's life until he gets back to the surface and can breathe in atmospheric air.

An attempt to add an open-circuit bailout to a closed-circuit rebreather was made in U.S. Pat. Nos. 4,964,404 and 5,127,398 by Stone. In the event of closed-circuit malfunction, the user can manually switch a valve incorporated in the mouthpiece to shut off the closed circuit and open a direct communication with a diluent supply to allow the user to exale directly therefrom.

The key element of the system invented by Stone is a mouthpiece which is excessively large and rather complex, as seen from U.S. Pat. No. 5,127,398. In fact, in the mouthpiece two independent breathing circuits meet, and means for switching from one breathing circuit to another are provided. A diver may feel uncomfortable having a mouthpiece as large as this in front of his face, and his field of view is confined.

Further, it does not always happen that a diver facing an emergency situation under water keeps cool and performs necessary actions such as switching a regulator in the mouthpiece. Therefore, it would be desirable to automate the switching to the open-circuit bailout. However, to achieve this with a prior art rebreather such as Stone's it would be necessary to add to the mouthpiece a solenoid and take a waterproof electric wiring thereto. This would make the mouthpiece even more large and complex.

BRIEF SUMMARY OF THE INVENTION

It is an object of the present invention to provide a self-contained underwater re-breathing apparatus, which supports diver's life in the event of an emergency.

A further object of the present invention is to provide a self-contained underwater re-breathing apparatus with a bailout system which is able to automatically switch to open-circuit breathing, wherein a large and complex mouthpiece is not needed.

A further object of the present invention is to provide a self-contained underwater re-breathing apparatus with a bailout system which does not require performing any actions from the diver.

These objects are achieved by providing a self-contained underwater re-breathing apparatus comprising a breathing circuit including a mouthpiece having an outlet for exaled gas and an inlet for inhaled gas, the breathing circuit further including at least one variable-volume container incorporated therein and a scrubber for scrubbing $CO_2$ from exaled gas, the scrubber having an inlet and outlet in communication with the first mouthpiece outlet and the mouthpiece inlet, respectively, the re-breathing apparatus further comprising a first breathable gas cylinder in communication with the breathing circuit through a pressure differential control valve, a shut-off valve in the breathing circuit upstream the control valve, an automatic control means comprising sensors for monitoring physical parameters in the breathing circuit, the automatic control means being adapted to close the shut-off valve when abnormal parameters are detected by the sensors, and a second breathable gas cylinder in communication with the breathing circuit through an automatic control valve controlled by the automatic control means; wherein the breathing circuit further comprises an exhaust valve for exhausting exaled gas when the shut-off valve is closed.

With the system of the invention, a part of the existing closed circuit is used for bailout, and no separate bailout circuit is provided. Therefore, there is no need to incorporate in the mouthpiece means for switching from one breathing circuit to another, and the mouthpiece can be kept smaller and simpler. Further, switching to bailout is fully automated, so that no actions are required from the diver.

Preferably, the opening pressure of the release valve is adjustable.

Preferably, the first breathable gas cylinder contains diluent gas, and the second breathable gas cylinder contains oxygen.

The control valve can be a pressure differential control valve.

Preferably, the exhaust valve is incorporated in the mouthpiece.

A means for shutting off the breathing opening can be provided in the mouthpiece.

More specifically, the mouthpiece can have a cylindrical rotatable insert having an opening and fixed to a stub tube extending outside, wherein by rotating the insert, its opening can either be aligned or misaligned with the breathing opening.

Said insert is can be rotated manually by acting on the stub tube, into which the exhaust valve is preferably incorporated.

BRIEF DESCRIPTION OF THE SEVERAL VIEWS OF THE DRAWING

These and other features, objects, and advantages of the present invention will be better appreciated from an understanding of the operative principles of a preferred embodiment as described hereinafter and as illustrated in the accompanying drawings wherein.

DETAILED DESCRIPTION OF THE INVENTION

Figure 1:
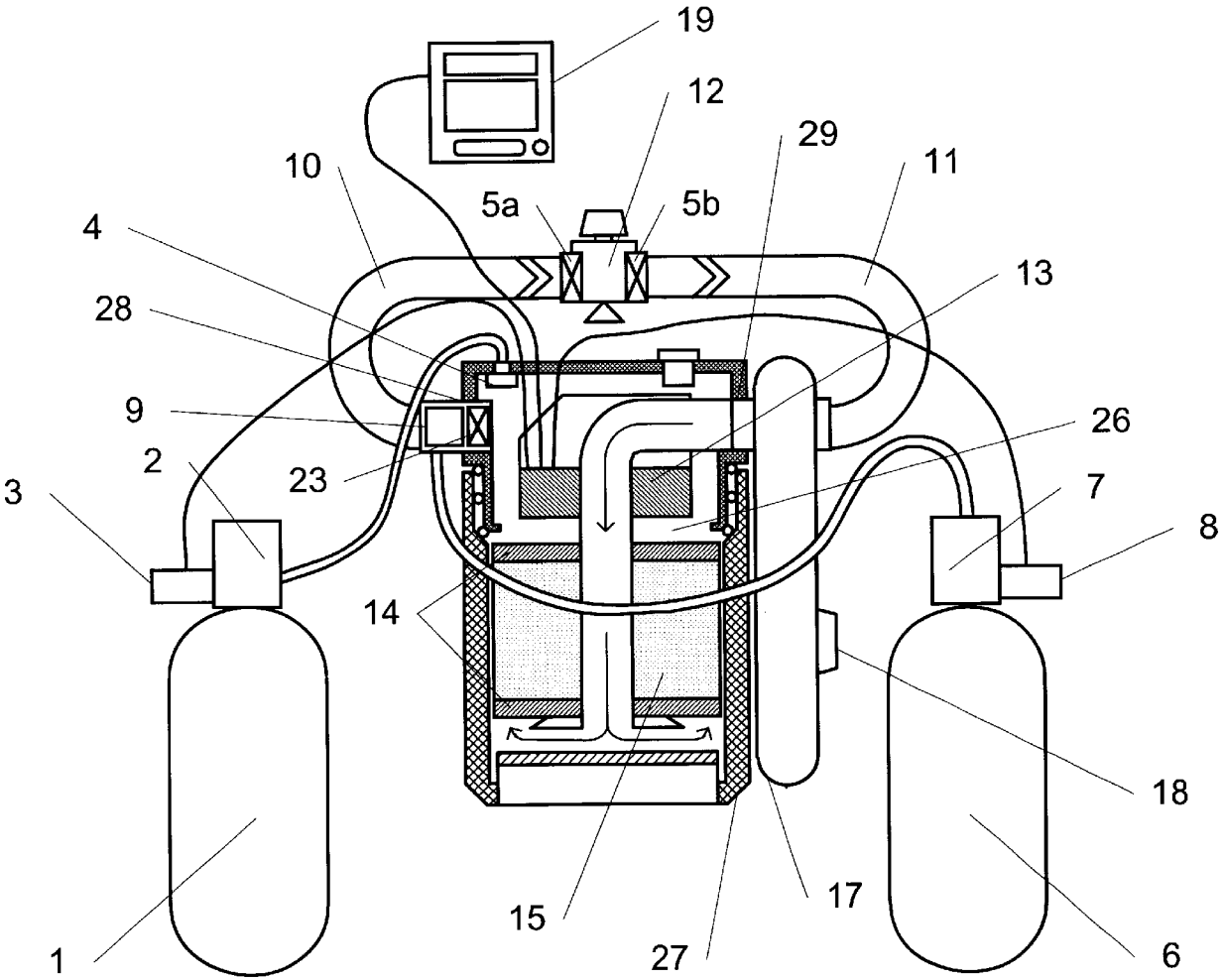
FIG. 1 is a schematic view of a rebreather according to the present invention.

One embodiment of a self-contained underwater re-breathing apparatus according to the invention is shown schematically in FIG. 1, the rebreather including a breathing circuit defined by a mouthpiece 12 in communication with a scrubber canister 27. Exalation hose 11 provides fluid communication of an outlet of the mouthpiece 12 with a counterlung 17 which in turn is in communication with an inlet 29 of the scrubber canister 27. Counterlung 17 is a variable-volume container in the form of a bag for receiving exaled gas. To throw off an exessive pressure from the breathing circuit a pressure-activated valve 18 is provided in the counterlung 17. Inhalation hose 10 provides fluid communication of an inlet of the mouthpiece 12 with an outlet 28 of the scrubber canister 27. To ensure that exaled gas is fed to hose 11, and inhaled gas is fed from hose 10, check valves 5*a* and 5*b* are provided at the inlet and outlet, respectively, of the mouthpiece.

Figure 4:
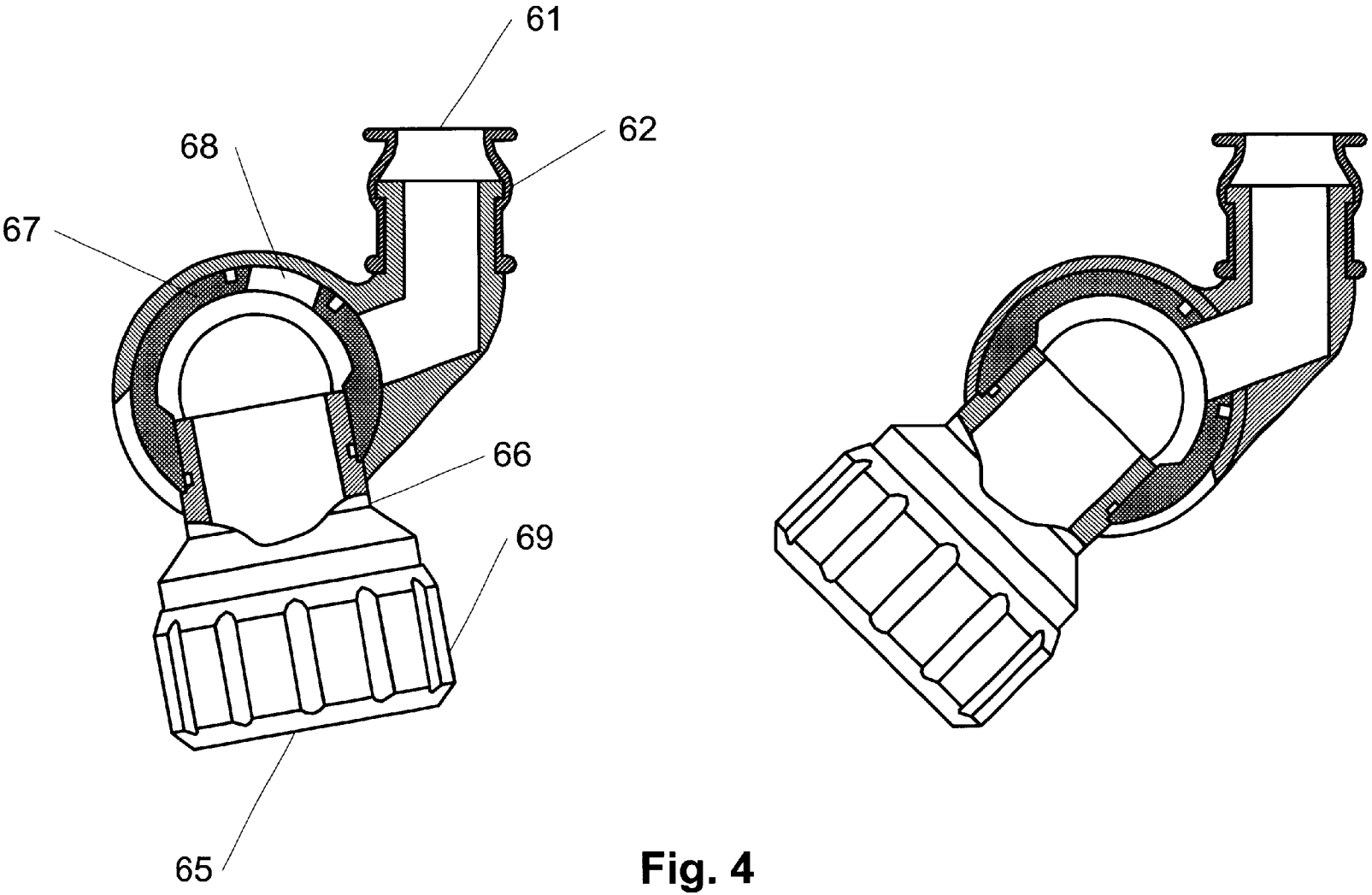
FIG. 4 is two sectional views of a mouthpiece for a rebreather of the present invention, wherein the mouthpiece is in open and closed state.
Figure 5:
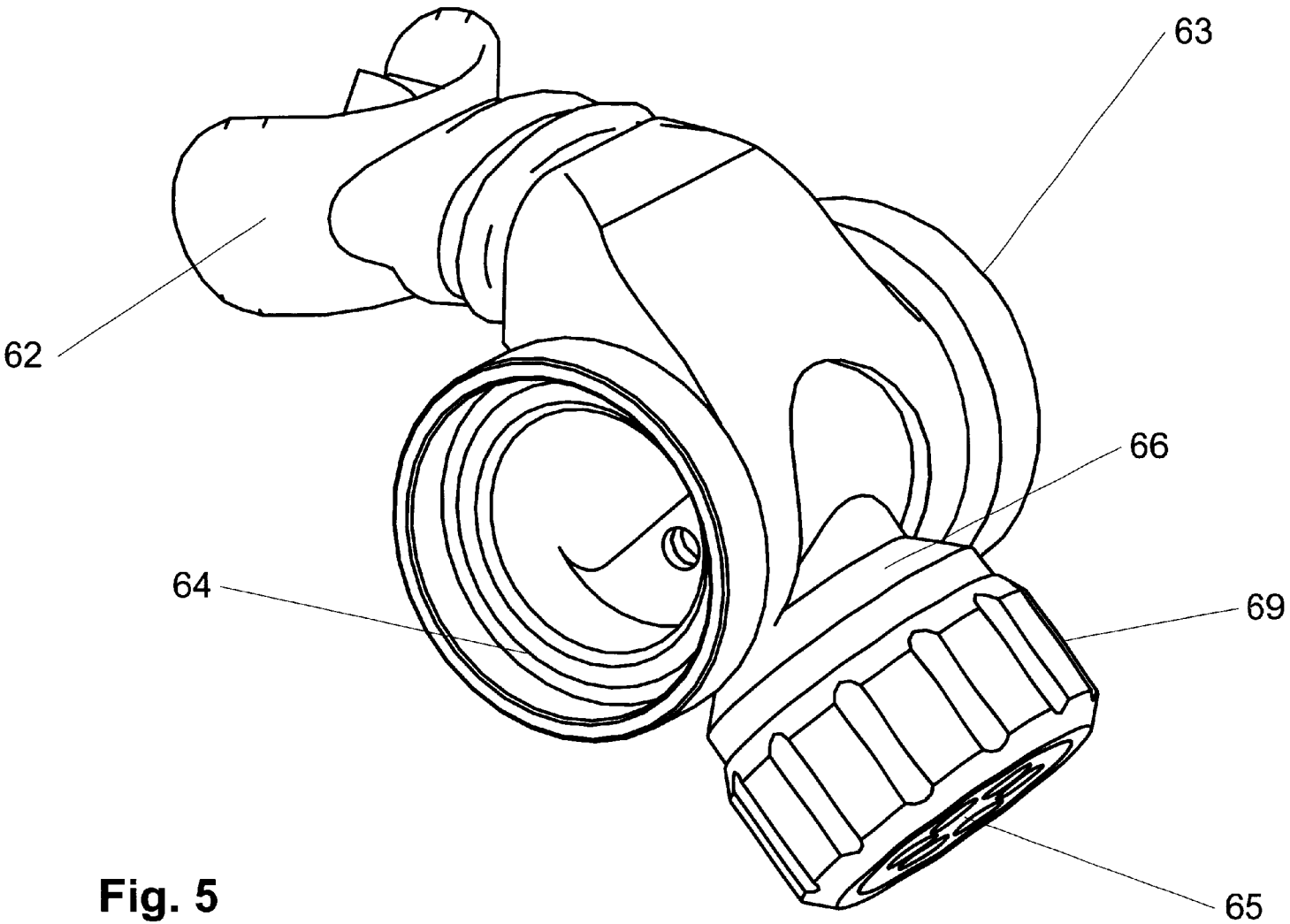
FIG. 5 is a perspective view of a mouthpiece for a rebreather of the present invention.

The mouthpiece 12 shown in FIGS. 4 and 5 is a hollow housing having a breathing opening 61 terminating in a rubber mouth bit piece 62, inlet 63 from and outlet 64 to, the breathing circuit, and an exhaust opening 65. The exhaust opening 65 is formed as a stub tube 66 having a pressure-activated exaust valve. Detailed structure of the exhaust valve is neither disclosed herein nor presented in the drawings because it is well known in the art and widely used in open-circuit SCUBAs. The exhaust valve can open to the environment at a predetermined pressure which can be adjusted manually by rotating a knob 69. Normally, the exhaust valve is adjusted to a pressure higher than normal pressures in the breating circuit, but not above the highest pressure that can be created by the diver's lungs.

A means for shutting off the breathing opening 61 are provided in the mouthpiece 12. A part of the mouthpiece housing between the inlet 63 and the outlet 64 is cylindrical, and has a cylindrical rotatable insert 67 therein, the insert being fixed to the stub tube 66. By rotating the insert, its opening 68 can either be aligned or misaligned with the breathing opening 61. The insert 67 is rotated manually by acting on the stub tube 66. A diver can need to shut off the breathing opening 61 in some emergency situations where he has to take the mouthpiece out of his mouth, e.g. to start breathing from a backup breathing circuit (not disclosed herein).

Referring back to FIG. 1, the scrubber canister 27 (adapted to be secured on the diver's back) comprises a scrubber unit 15 usually in the form of a sheet roll sandwiched between filters 14. Alternatively, scrubber unit 15 can be a granular filling. Scrubber unit 15 contains chemicals capable of absorbing $CO_2$ from exaled gas passed therethrough. In the scrubber canister 27 downstream the scrubber unit 15 a chamber 26 is formed, partly occupied by an automatic control system 13 described below. Thus, electronics of the automatic control system is located within a secure, moisture-proof housing of the canister.

The gas flow in the scrubber canister 27 is arranged in such a way that exaled gas entering the inlet 29 passes through the scrubber unit 15 to the chamber 26 and out to the outlet 28.

An injection system for adding fresh breathable gas to the breathing circuit includes an oxygen cylinder 1 containing compressed oxygen and communicated to the breathing circuit, namely, to chamber 26 via solenoid control valve 4. The cylinder has a pressure regulator 2 for adjusting pressure of oxygen injected to the breating circuit. The injection system futher includes diluent gas cylinder 6 containing compressed diluent gas, which is usually a standard breathable mixture of oxygen and a nontoxic inert gas. Cylinder 6 has pressure regulator 7 for adjusting pressure of diluent gas injected to the breating circuit. This cylinder is in fluid communication with the breathing circuit via pressure-activated regulator 9 having a second stage control valve.

The automatic control system 13 includes a microcomputer electrically connected with sensors for monitoring physical parameters both outside and inside the breathing circuit. On the other hand, the microcomputer is electrically connected with the solenoid of oxygen valve 4 for controlling the injection of oxygen into the breathing circuit in accordance with current values of the physical parameters monitored by the sensors. Further, the microcomputer is electrically connected with a handset 19 having an indicator and manual controls.

The microcomputer includes a microcontroller 55 responsible for adding oxygen to the breathing circuit and a microcontroller 56 for providing information on diving profile to the handset.

Among the sensors are oxygen sensors 41, a carbon dioxide sensor 42, an inert gas sensor 43, temperature sensors 44, and a water sensor 46. These sensors are electrically connected to the microcomputer. The sensors, especially carbon dioxide sensor 2, are disposed in the vicinity of oxygen supply valve 4, so that dry oxygen is blown across the sensors. This avoids humidity condensation and provides higher accuracy.

For monitoring the amount of oxygen and diluent gas in cylinders 1 and 6 these cylinders are provided with respective sensors 3 and 8 electrically connected to the microcomputer. Readings from these sensors are displayed by the handset.

A solenoid shut-off valve 23 is incorporated in the breathing circuit upstream the control valve. Preferably, shut-off valve 23 is disposed within the canister 27. In this embodiment, shut-off valve 23 is disposed in the scrubber outlet 28. Solenoid of shut-off valve 23 is electrically connected to the microcomputer. Thus, the solenoid is safely and conveniently disposed within the canister 27 in the vicinity of other electronics.

During the dive, the diver exales to the breathing circuit. Through check valve 5*b* exaled gas enters hose 11 and fills counterlung 17. Check valve 5*a* prevents the exaled gas from entering hose 10. When the diver inhales, his lungs create a vacuum which draws the exaled gas from counterlung 17 to scrubber canister 27 and further downstream the breathing circuit. In the scrubber canister, the exaled gas is scrubbed from $CO_2$ to maintain partial pressure of carbon dioxide or $PPCO_2$ downstream the scrubber less than 0.005 ATA.

$CO_2$-depleted gas is fed to hose 10 and, through check valve 5*a*, back to mouthpiece 12, and the diver's lungs, while check valve 5*b* prevents gas in hose 11 from entering the mouthpiece. $PPO_2$ in the exaled gas is decreased due to metabolism. When $O_2$ sensors detect a decreased $PPO_2$ in the breathing circuit as compared to a predetermined level, microcomputer activates solenoid control valve 4 to add deficient oxygen to the breathing circuit.

When the diver descends, the outside pressure increases. This leads to pressure difference between the breathing circuit and the outside. Under this pressure difference, regulator 9 is activated providing a corresponding rise of pressure in the breathing circuit by adding some diluent gas from cylinder 6.

Abnormal readings of at least one sensor are analysed by the automatic control means. If hazard to the diver's life is detected, shut-off valve 23 is closed. This will close the breathing circuit, and an open-circuit bailout will automatically be actuated. More specifically, vacuum created by the diver's inhalation will cause pressure difference between the breathing circuit and the outside. This will open pressure-activated regulator 9, and diluent gas will come from cylinder 6 to the part of the breathing circuit downstream shut-off valve 23, that is, to hose 10 and inlet 5*a* to mouthpiece 12. Thus, the diver will inhale diluent gas from cylinder 6.

When the diver exales, the pressure downstream the mouthpiece outlet opening will increase because the breathing circuit is shut off. The increased pressure will open the exhaust valve, and the exaled gas will be released to the environment. To facilitate exalation, the diver can adjust the exhaust valve to a lower pressure. However, even if he does not do that, the exaled gas wil still be exhausted because, as mentioned above, the exhaust valve is normally adjusted to a pressure not higher than the highest pressure that can be created by the diver's lungs.

This means that the diver can breathe in an open-circuit mode. More specifically, the diver inhales from cylinder 6 through pressure-activated regulator 9, hose 10, and mouthpiece 12, and exales through the exhaust valve. Thus, a part of the existing closed circuit is used for bailout, and no separate bailout circuit is provided. Therefore, there is no need to incorporate in the mouthpiece means for switching from one breathing circuit to another, and the mouthpiece can be kept smaller and simpler. As described above, switching to bailout is fully automated, so that no actions are required from the diver.

Figure 3:
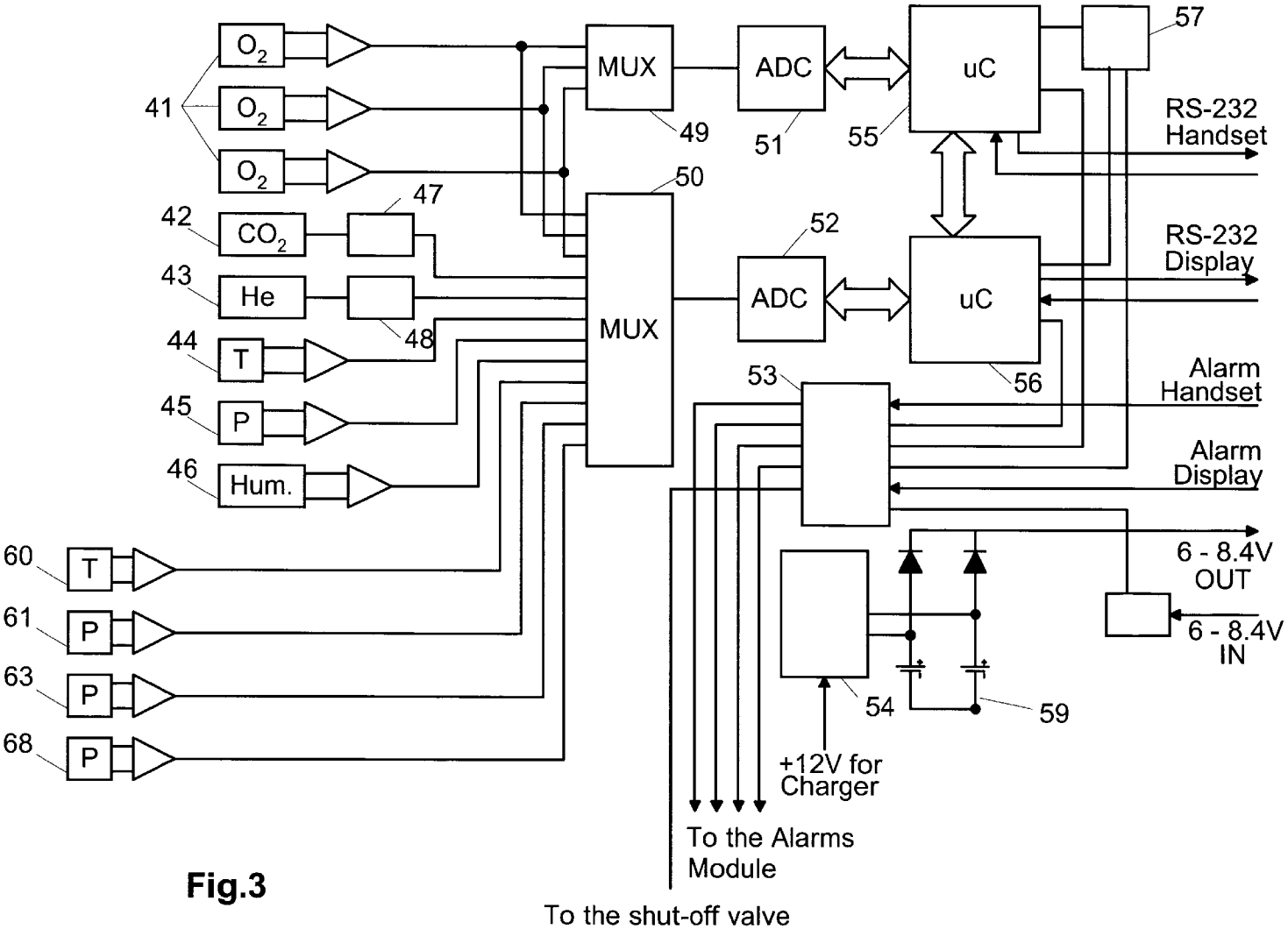
FIG. 3 is a block diagram illustrating automatic control system for a rebreather according to the present invention.

Automatic control system 13 is described below in more details with reference to a circuit diagram shown in FIG. 3.

The automatic control system 13 maintains the required level of $ppO_2$ in the breathing circuit, monitors gas mixture, and provides the diver with life critical information on the diving process.

Output signals from oxygen sensors 41 are transmitted through three-to-one analogue multiplexer 49 to the input of the analogue-to-digital converter 51. Oxygen control microcontroller 55 regularly reads data from analogue-to-digital converter 51 and calculates the partial pressure of oxygen in the breathing circuit. Microcontroller 55 takes the median of the two closest signals as already mentioned above as being the true oxygen value. The result is used to maintain an accurate $ppO_2$ in the breathing circuit, within $ppO_2$ of +/−0.05. The sensors are located adjacent to the output 28 of chamber 26.

When the level of the $ppO_2$ in the breathing gas is below a predefined level, microcontroller 55 generates signals to solenoid valve circuitry 57 to activate oxygen valve 4 to feed a portion of oxygen from cylinder 1 to the breathing circuit. In case of failure, solenoid valve circuitry 57 produces an alarm signal and sends it to alarm circuitry 53 and further to shut-off valve 23 in order to activate the bailout system. Other situations in which the bailout system is activated are indicated in Table 1 below.

From the alarm circuitry 53, the alarm signal also comes to an alarms module (not shown). The alarms module has a buzzer and ultrabight red LED. This module is fully controlled by the alarm circuitry 53. Alarms module is usually located on the diver's mask in such a way that the diver can see the LED and hear the buzzer.

To provide the diver with information on the current state of the diving process, automatic control system 13 includes breathing gas monitor microcontroller 56. Signals from sensors 41, 44–46, carbon dioxide monitor 47, helium monitor 48, ambient water temperature sensor 60, ambient pressure sensors 61, and pressure sensors 3, 8 are transmitted through multiplexer 50 to the input of analog-to digital converter 52. The microcontroller 56 reads data from analog-to digital converter 52, computes the current content of the breathing gas mixture, and transmits the information to display module 19. In case of abnormal readings of one or more sensors, the content of the breathing gas will be found abnormal. This will lead to activation of the alarm module and bailout system. Specific situations in which the bailout system is activated are indicated in Table 1 below.

The automatic control system 13 is powered from battery pack 59. When the batteries are discharged, the diver has an opportunity to re-charge the batteries. Automatic control system 13 has a charge unit 54 with two independent charge channels. A voltage of +12V is used for charging.

The estimated service life of the scrubber is calculated based on his design life each time a new scrubber is fitted. Before diving, the system requests from the user the intended duration of his dive. If this duration exceeds the estimated scrubber life, the system rejects the dive and warns "No dive", "Insufficient scrubber".

Figure 2:
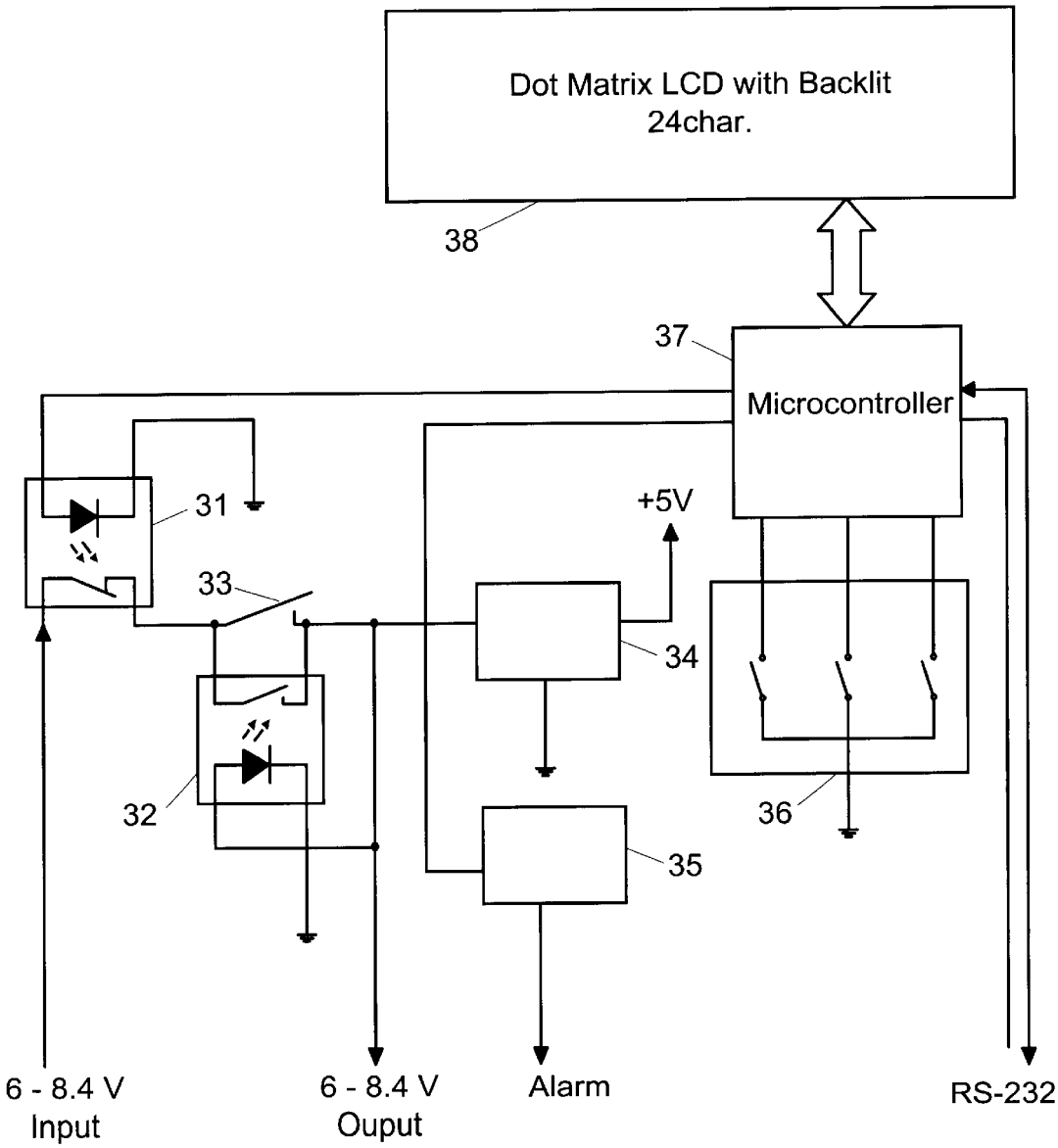
FIG. 2 is a sectional view of a mouthpiece for a rebreather of the present invention.

FIG. 2 is a circuit diagram representing handset 19 in accordance with the preferred embodiment of the present invention.

According to the present embodiment, handset 19 allows the diver to set the desired parameters of the dive, check manually gas control electronics, and calibrate the oxygen sensors.

The diver switches on power by initiating the normally opened reed switch 33. The power from the batteries, coming across a normally closed solid-state relay 31 and the closed contact of reed switch 33, activates a normally opened solid-state relay 32. The contact of the relay 32 will be closed, thus powering the handset and electronics. To switch power off electronics of the rebreather, at least two of reed Hall-effect switches 36 should be pressed, then, after the confirmation by the diver, the power will be switched off by opening the closed contact on relay 31. This prevents accidental switching the power off during the dive.

The handset has its own alarm circuitry. Alarm signal is generated in case of microcontroller 37 or power failure.

The handset is powered from the 5V power regulator 34 with a low dropout.

Initiating Hall-effect switches 36 defines a change in different modes of operation of the rebreather. Microcontroller 37 decodes the combination of the switches and passes messages to the diver on a dot matrix LCD 38 with a red 680 nm backlit. Each change of state of the Hall-effect switches 36 activates the backlit diode of the LCD for several seconds, and the diver will hear a short sound from the buzzer. Thus, the diver is provided with a means for controlling the adequacy of instructions. The handset communicates with the automatic control system 13 via RS-232 interface. Handset shows all key data and operating instructions in the LCD 38, which is switched on in the event of alarm, and/or when any button is pressed.

The LCD 38 displays:

DIVE DATA: Total dive time (h, mm), Max Depth (ddd), Time to surface (h, mm), Ceiling (nnn), Time at ceiling (h, mm, ss), Gas %: He, $N_2$, $O_2$, Water Temperature, Ascent rate (+/− ft/s or m/s);

INSTRUCTION DISPLAY: 24 char alpha numeric, red backlit;

CAUSE DISPLAY: 24 char alpha numeric, red backlit;

CRITICAL DATA: $ppN_2$, $ppO_2$, $ppCO_2$, Battery (%);

SENSORS: Select $O_2$ (x3), He, ppCO2, Battery V, Idd, Humidity;

GAS SUPPLIES: $O_2$ cylinder pressure, Diluent gas cylinder pressure, Scrubber life.

An important feature of the handset according to the invention is that in addition to actual figures, the diver is provided with information on the cause of this or that situation, together with clear instructions, so that the diver does not have to analyse the figures and take decision in stress situation.

An approximate list of potentially dangerous situations in which instructions to the diver are generated is shown in Table 1. Situations 1, 3, 4, 6, and 7 can be managed, and bailout is not necessary. Therefore, the shut-off valve remains open, whereas the diver is instructed on further actions. In situations 2, 5 and 8–11 the diver faces a deadly danger, therefore the shut-off valve is closed and bailout is activated.

We claim:

1. Self-contained underwater re-breathing apparatus comprising a breathing circuit including:

a mouthpiece having a breathing opening, an outlet for exaled gas and an inlet for inhaled gas, the breathing circuit further including at least one variable-volume container incorporated therein and a scrubber for scrubbing $CO_2$ from exaled gas, the scrubber having an inlet and outlet in communication with the mouthpiece outlet and the mouthpiece inlet, respectively, the re-breathing apparatus further comprising:

a first breathable gas cylinder in communication with the breathing circuit through a pressure differential control valve, a shut-off valve in the breathing circuit upstream the control valve, an automatic control means comprising sensors for monitoring physical parameters in the breathing circuit, the automatic control means being adapted to close the shut-off valve when abnormal parameters are detected by the sensors, and a second breathable gas cylinder in communication with the breathing circuit through an automatic control valve controlled by the automatic control means;

wherein the breathing circuit further comprises an exhaust valve for exhausting exaled gas when the shut-off valve is closed.

2. Self-contained underwater re-breathing apparatus according to claim 1, wherein the opening pressure of the release valve is adjustable.

3. Self-contained underwater re-breathing apparatus according to claim 1, wherein the first breathable gas cylinder contains diluent gas.

4. Self-contained underwater re-breathing apparatus according to claim 3, wherein said control valve is a pressure differential control valve.

5. Self-contained underwater re-breathing apparatus according to claim 3, wherein the second breathable gas cylinder contains oxygen.

6. Self-contained underwater re-breathing apparatus according to claim 1, wherein the exhaust valve is incorporated in the mouthpiece.

7. Self-contained underwater re-breathing apparatus according to claim 6, wherein a means for shutting off the breathing opening is provided in the mouthpiece.

8. Self-contained underwater re-breathing apparatus according to claim 7, wherein the mouthpiece has a cylindrical rotatable insert having an opening and fixed to a stub

TABLE 1

| NO. | TRIGGER | INSTRUCTION | CAUSE | BUZZER | LED | SHUT-OFF VALVE |
|---|---|---|---|---|---|---|
| 1 | $ppO_2$ < set $ppO_2$-0.3 | "Inject $O_2$"/"Do NOT ascend" | "$ppO_2$ is low" | On slow | On slow | Open |
| 2 | $ppO_2$ < 0.20 | "Bail out NOW!"/ "Do NOT ascend on RB" | "No Oxygen" | On fast | On fast | Closed |
| 3 | On standby battery | "Abort Dive" | "On standby power" | Int | Int | Open |
| 4 | $ppCO_2$ > 0.05 | "Abort Dive" | "High $ppCO_2$" | Int | Int | Open |
| 5 | $ppCO_2$ > 3.5 | "Bail out NOW!" | "Scrubber failure" | On fast | On fast | Closed |
| 6 | $ppN_2$ > 4 | "Ascend slowly" | "$N_2$ Narcosis" | Int | Int | Open |
| 7 | $ppO_2$ > 1.6 | "Flush & Shut off $O_2$" | "$O_2$ solenoid stuck on" | On med | On med | Open |
| 8 | Depth < 1 m and checks not complete | "No dive" | "Checks not complete" | Off | off | Closed |
| 9 | Current > 60 mA av. 10 sec | "Bail out NOW" | "System failed (Icc H)" | On fast | On fast | Closed |
| 10 | Current < 10 mA av. 10 sec | "Bail out NOW" | "System failed (Icc L)" | On fast | On fast | Closed |
| 11 | Humidity sensor RH > 98% | "Bail out NOW" | "System is Flooding" | On fast | On fast | Closed |

tube extending outside, wherein by rotating the insert, its opening can either be aligned or misaligned with the breathing opening.

9. Self-contained underwater re-breathing apparatus according to claim 8, wherein the insert is rotated manually by acting on the stub tube.

10. Self-contained underwater re-breathing apparatus according to claim 8, wherein the exhaust valve is incorporated in the stub tube.

* * * * *